US006089498A

United States Patent [19]

Sticht

[11] Patent Number: 6,089,498

[45] Date of Patent: Jul. 18, 2000

[54] MONITORING MEANS FOR AN END OF A THREAD-LIKE MATERIAL WOUND ON A SUPPLY COIL AND PROCESS FOR THIS

[76] Inventor: Walter Sticht, Karl-Heinrich-Waggerl-Strasse 8, A-4800 Attnang-Puchheim, Austria

[21] Appl. No.: 09/332,727

[22] Filed: Jun. 14, 1999

[30] Foreign Application Priority Data

Jun. 26, 1998 [AT] Austria ..... 1111/98

[51] Int. Cl.[7] ..... B65H 26/00; B65H 43/00; B65H 63/00; B65H 19/10; B65H 21/00

[52] U.S. Cl. ..... 242/563; 242/554.5

[58] Field of Search ..... 242/563, 563.2, 242/131, 413, 554.5, 485.5

[56] References Cited

U.S. PATENT DOCUMENTS 4,119,279 10/1978 Hosbein ..... 242/563.2
4,516,713 5/1985 Meijer ..... 242/563.2
4,768,728 9/1988 Jenny et al. .
4,988,051 1/1991 Welschlau et al. .
5,184,786 2/1993 Brockmanns et al. .
5,769,353 6/1998 Juhe et al. ..... 242/563
5,788,171 8/1998 Okabayashi .
5,816,514 10/1998 Duclos et al. ..... 242/563 X

*Primary Examiner*—Donald P. Walsh
*Assistant Examiner*—Collin A. Webb
*Attorney, Agent, or Firm*—Collard & Roe, PC

[57] ABSTRACT

The invention relates to a monitoring means (1) for an end of a thread-like material (2) wound on a storage coil (3), in particular an electrical conductor provided with an electrically insulating coating for a processing machine, comprising a computer unit (24) and a memory location (25, 26) for a desired residual quantity of the thread-like material (2). A weighing device (17 to 22) is provided for at least intermittently receiving the storage coil (3), the measured value transducer of which is connected to the computer unit (24) and a further memory location (25, 26) is provided for the tare weight at least of the storage coil (3).

36 Claims, 7 Drawing Sheets

MONITORING MEANS FOR AN END OF A THREAD-LIKE MATERIAL WOUND ON A SUPPLY COIL AND PROCESS FOR THIS

BACKGROUND OF THE INVENTION

1. Field of the Invention

The invention relates to a monitoring means for an end of a thread-like material wound on a supply coil, in particular an electrical conductor provided with an electrically insulating coating for a processing machine, comprising a computer unit and a memory location for a desired residual quantity of the thread-like material, and a process for monitoring the consumption of a thread-like material unwound from a supply coil and/or for detecting the end of the residual quantity of the thread-like material on an unspooling storage coil.

2. The Prior Art

Coil winding machines are known on which several coils are produced synchronously by winding wires onto several coil carrier members. Above all, where winding machines are concerned in which a plurality of coils are wound simultaneously, the proportion of the time taken for resetting operations as a result of replacing empty supply coils with full ones represents a corresponding expenditure. It is above all a disadvantage when the end of the wire is missed and the wire is fully pulled out from the winding machine and has to be completely re-threaded from the wire take-up to the winding head.

SUMMARY OF THE INVENTION

The object of the present invention is to provide a monitoring means and a process, with which the end of the thread-like material, in particular comprising threads, synthetic or natural materials, strands, wires or similar, can thus be recognised promptly so that the thread-like material is not pulled out of the wire take-up and the following winding region.

This invention is achieved in that a weighing device is provided for at least intermittently receiving the storage coil, the measured value transducer of which is connected to the computer unit and a further memory location is provided for the tare weight at least of the storage coil. The advantage in this solution is that a specific residual quantity of the thread-like material can now be pre-defined and this residual quantity can be simply monitored by precise checking of the weight of the supply coil, taking into consideration the tare weight, and can be quickly established, by means of which renewed start-up of a winding process can be prevented when the desired residual quantity has been reached. This also precludes the possibility of the quantity of the thread-like material no longer being sufficient during a winding process and of the thread-like material possibly being pulled through the wire take-up and thus of the thread-like material being pulled out of the wire take-up and the following parts of the winding device. However, this advantageously permits quick resetting times when replacing empty storage containers with full ones, since only the storage coil when empty but for the residual quantity needs to be removed and replaced by a full supply coil, and the end, located in front of the wire take-up, of the thread-like material of the preceding storage coil is joined to the starting edge of the thread-like material of the new full storage coil either by a non-positive, or possibly a positive, connection, whereupon the winding process can be continued once again. Moreover, it is possible with this embodiment to detect this required replacement and to appropriately mark the produced inductive coil, in which the contact point between the thread-like material of the preceding storage coil and the new full supply coil, so that this can be easily be removed as a faulty part. Thus, it is possible in a simple manner to prevent the thread-like material from running out of the wire take-up and the winding devices downline even when the wire length or wire quantity required in one winding process amounts to a multiple of the wire length or wire quantity between the storage coil and the carrier member for production of the coil.

A variant, in which the desired residual quantity of the thread-like material is greater than a removal quantity of thread-like material required in a removal cycle, is advantageous, since as a result of this the possibility of half-finished wound coils being formed is reliably excluded.

The variant, in which the desired residual quantity of the thread-like material amounts to at least 1.5-times the removal quantity required in a removal cycle, also allows weight differences resulting from tolerances in wire thickness and/or deviations in tare weight to be taken into account, and nevertheless enables further winding processes to be blocked in good time so that fully finished wound coils may always be produced.

A further development, in which the computer unit is constructed for output of a control signal when the value of the desired residual quantity is the same as or falls below a current value established with the measured value transducer and/or the computer unit, in particular for the mass or weight of the thread-like material on the storage coil, is also advantageous, since as a result of this the function of the coil winding machine can be interrupted in a simple manner if an insufficient quantity of wire for production of a complete coil is present on the storage coil.

However, a further development, in which the computer unit is constructed for output of a preliminary warning signal when the value of the selection residual quantity is the same as or falls below a current value established with the measured value transducer and/or the computer unit, in particular for the mass or weight of the thread-like material on the storage coil, is also advantageous, since because of the preliminary warning signal preparation steps for coil replacement may be initiated in good time before the winding process has to be interrupted for exchange of the storage coils, and any storage coil, to which the preliminary warning signal had been emitted, may possibly be monitored more precisely and at shorter time intervals to ensure that it is reliably detected that the desired residual quantity has been reached.

It is also an advantage, when the selection residual quantity of the thread-like material is greater than the desired residual quantity, because as a result of which the reaction time up to the replacement of a supply coil is extended.

A configuration, in which the weighing device is provided for at least intermittently receiving several different storage coils and its measured value transducers are connected to the computer unit, is also advantageous, since this enables the filling status of several storage coils to be scanned one after the other with only one weighing device.

As a result of the variant, in which the storage coil, in which the selection residual quantity or preliminary warning limit is reached or the preliminary warning signal is emitted by the computer unit, remains on the weighing device until the desired residual quantity has been reached and the control signal has been transmitted, it is possible, by selective monitoring of the weight of the individual storage coils, to detect as early as possible those containing the lowest possible residual quantity of thread-like material in order to precisely monitor that the desired residual quantity has been reached by continuous monitoring of this promptly detected storage coil. As a result, the possibility of an unforeseen disturbance in the winding process because of a production fault, with the exception of a non-foreseeable wire tear, is excluded and a high availability of such coil winding devices can be achieved.

An improvement can be achieved with the configuration, in which several weighing devices are provided to receive several different storage coils and their measured value transducers are connected to the computer unit, since a continuously run monitoring of the weight of the individual storage coils is possible, as a result of which other irregularities in the storage coils, such as wire jams or similar, for example, which lead to higher pulling force and increase the risk of a wire tear, can be detected in good time and any threatening production disturbances may possibly be prevented in good time by early detection.

An even more precise detection of the desired residual quantity may be achieved, when the computer unit has several memory locations allocated to each weighing device for the tare weight and/or the quantity of thread-like material, in particular the weight of the thread-like material on the storage coil.

When the weighing device is provided for at least intermittently receiving several different storage coils and its measured value transducers are connected to the computer unit, it allows continuous adaptation of the discharge force onto the thread-like material and its monitoring.

A further configuration, in which a measuring amplifier with an integrating mechanism is connected downline of the measured value transducer, is also advantageous, since as a result of this several measured values detected in direct succession can be used to form an average measured value and thus any individual irregular points occurring, which could lead to erroneous displays, can be screened out.

However, the configuration, in which the measured value transducer and/or the measuring amplifier are connected to the computer unit via a bus system, is also advantageous, since by transmitting full measured values via the bus system, a short total cycle time is possible, within which the measured values of several measurement transducers from several weighing devices may also be detected.

However, is also advantageous, when a calibration weight of the weighing device corresponds approximately to the tare weight, since the highest precision of the winding device is achieved when the objective is to detect the desired residual quantity of the thread-like material, and therefore any inaccuracies of the weighing device cannot unfavourably influence the measurement result in the continuous production process.

The use of the monitoring device, in which the monitoring means is arranged upline of a wire take-up of the processing machine, in particular a winding machine for inductive coils, is advantageous in the case of a winding machine, since as a result of this the availability of such machines can be considerably increased.

A further development, in which the control signal of the computer unit prevents activation of at least one winding head and/or an associated drive of the winding machine, assures that the production of faulty coils on the winding machine can be reliably prevented, or that any coils with faulty windings may be detected prior to the start of production and their quantity may be calculated, or these faulty parts can be removed in good time and reliably from the production process with a connection point between the outgoing thread-like material and the thread-like material of a new storage coil.

Irrespective of this, however, the object of the invention is also achieved by a process for monitoring the consumption of a thread-like material unwound from a supply coil and/or for detecting the end of the residual quantity of the thread-like material on an unspooling storage coil. The surprising advantages resulting from the combination of features of this claim are that a storage coil in consumed state can be detected early, and therefore appropriate measures can be taken promptly so that, on the one hand, production outages can be minimised by the monitoring means according to the invention, and also the continuous monitoring of a processing machine for the thread-like material by a person becomes substantially unnecessary. It is additionally advantageous that measurement reports or production reports can be drafted in a simple manner, with which the quality and/or productivity of the processing machine can be continuously optimised.

In addition, a procedure, where the measured values provided by the measured value transducers of the weighing devices are compared with a desired residual quantity and/or with a comparatively larger selection residual quantity for the thread-like material is advantageous because a storage coil about to become completely empty or a storage coil in consumed state can be detected early as a result, and thus appropriate measures, e.g. a preliminary warning signal to the machine operator, can be initiated in good time and as a result the operator may already be able to make preparations which will considerably reduce the resetting time.

A further advantageous procedure, where the selection residual quantity is reached or fallen short of, an optical and/or acoustic preliminary warning signal is generated, and/or when the desired residual quantity is reached or fallen short of, a control signal is emitted, in particular to stop the processing drive of a processing machine for the thread-like material, since as a result of this an urgent message can be made to the machine operator, or the possibility of the thread-like material being completely pulled out of the guide device of the processing machine can be excluded.

The procedure, where an optical and/or acoustic message, in particular a command for exchange of at least the storage coil when in consumed condition, is emitted with the control signal, removes the need for constant observation of the processing machine by the operator and nevertheless allows maximum productivity to be achieved.

A procedure, where large surges in measured values, in particular heavy increases in measured values, are recognised as an exchange of the storage coil and at least the next produced product is removed as faulty, is also advantageous, since as a result the new processing process can be substantially started fully automatically after the exchange of the emptied storage coil.

The measures, where before the continuing weight detection of the storage coils, the weighing devices and/or the measured value transducers and/or the evaluation device or computer unit are calibrated, are also advantageous, since a high-precision and reliable detection of the quantity of thread-like material on the storage coil is achieved, even with continued usage of the plant, as a result of the possibility of calibrating the monitoring means. It is additionally advantageous that the storage coils with the thread-like material can be brought very close to empty state, since the measured value detection is reliable as a result of the calibration even when the storage coils are in the empty state. As a result, the thread-like material on the storage coils is utilised in the best possible manner and nevertheless a complete removal of the thread-like material from the processing machine is prevented.

As a result of the measures, where calibration is performed by laying at least one reference mass on the weighing devices and/or by completely relieving the load thereof, and a measurement curve, which substantially compensates non-linearities of the measured value transducers, is calculated on the basis of the deviations between the reference masses laid thereon and the read-in measured values of the measured value transducers, the tolerances of the individual components of the monitoring means are substantially compensated, so that a true measured value detection is achieved over the entire measurement range, but in particular at the beginning of the measurement range in the region of a zero mass.

As a result of the measures, where the value for the tare weight of the storage coil flows into the monitoring process, fluctuations in the coil body of different storage coils have no influence whatsoever on the actual residual quantity of thread-like material on the respective storage coil.

Finally, a procedure, where the continuously read-in measured values and/or differences between successive measured values serve as magnitude for the quality of the produced product, in particular the produced inductive coils, and/or as magnitude for the quality of the thread-like material on the storage coil, is advantageous since the monitoring means can thus be used simultaneously as an instrument for a continuous quality optimisation.

BRIEF DESCRIPTION OF THE DRAWINGS

The invention is explained in more detail on the basis of the embodiment shown in the drawings, wherein.

DETAILED DESCRIPTION OF PREFERRED EMBODIMENTS

Figure 1:
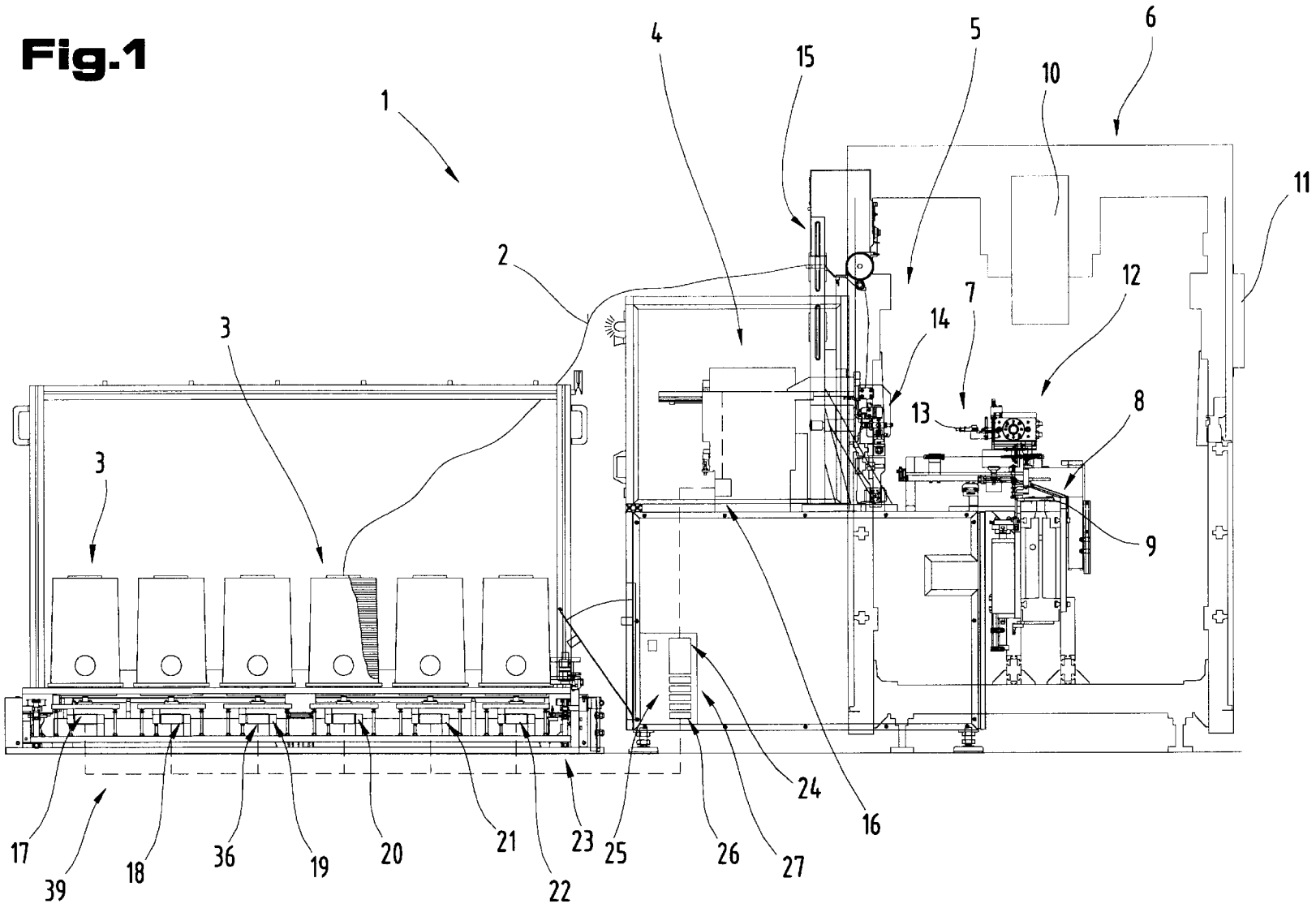
FIG. 1 is a simplified schematic side or face view of a monitoring means according to the invention in association with a winding machine.

Firstly, it should be noted that in the different embodiments described, the same parts will be given the same references or the same structural part designations, whereby the disclosures contained in the entire description can be transferred accordingly to the same parts with the same references or the same structural part designations. Similarly, the position details selected in the description, e.g. top, bottom, to the side etc., refer to the figure directly described and shown, and may be transferred accordingly to the new position in the case of a change in position. In addition, individual features or combinations of features from the different embodiments shown and described may in themselves also represent independent or inventive solutions or solutions according to the invention.

FIGS. 1 to 4 show a monitoring means 1 according to the invention for the supply of a thread-like material 2 from supply coils 3 to a winding drive 4 of a processing machine 5, in particular a winding machine for coils. This processing machine 5 is a component of a fully automatic assembly plant 6 for the production of inductive coils 7 or of structural parts in which coils 7 are integrated.

The assembly plant 6 additionally comprises a continuous, revolving transport device 8 in the manner of a revolving chain with workpiece supports 9, onto which the individual structural parts or coils 7 are moved from one work station to the next. The entire control and monitoring operation as well as regulation of the assembly plant 6 is performed by means of control devices 10 and display and monitoring devices or control panels 11, whereby the usually present connection lines between these and the transport device 8 or handling devices 12 for manipulation of the coils 7 have been omitted for reasons of clarity.

The configuration, arrangement and structure of such assembly plants 6 are well known to the person skilled in the art and are known in a wide variety of forms.

In the present case, the handling device 12 serves to remove the carrier members 13 for the coils 7 from the workpiece supports 9 and feed them to winding heads 14 of the processing machine 5. The processing machine 5 shown here is constructed for the simultaneous production of windings on several adjacent carrier members 13 of the coils 7. Feed of the thread-like material 2 to the individual winding heads 14 is carried out over these wire take-up means 15 arranged upline, whereby winding drives 4 are allocated to these winding heads 14.

For control of the processing machine 5, a control device 16 is allocated thereto.

Similarly, the configuration of the processing machine 5 or coil winding machine has been known for a long time in a wide variety of variants and technical solutions and the person skilled in the art is conversant with this, which is why detailed representation of such processing machines 5 has been omitted to improve clarity.

The monitoring, control or regulation of the feed of the thread-like material 2 from storage coils 3 to the winding heads 14 is essential for high load and disturbance-free operation of such a processing machine 5. For this purpose, the monitoring means 1 according to the invention is provided, which has several weighing devices 17 to 22, whereby two such weighing devices 17 to 22 are respectively given the same references and the weighing devices 17 to 22 are arranged parallel to one another in two rows running parallel to one another—as may be seen from FIG. 3. This configuration of the monitoring means is therefore suitable for ensuring the supply of thread-like material 2, in particular in the form of copper enamelled wire, to a processing machine 5 with twelve winding heads 14.

However, it is, of course, also possible to supply processing machines 5 with few winding heads 14 with a correspondingly reduced number of weighing machines 17 to 22 or when these are only being partially utilised.

Besides the weighing devices 17 to 22 arranged on a support frame 23, the monitoring means 1 also comprises a computer unit 24 with memory locations 25, 26, which overall form a control device 27.

Each of these weighing devices 17 to 22 comprises a weighing plate 28, which is disposed to be adjustable perpendicular to the receiving plane of the support frame 23 via vertical guide means 29 with excess load stops 30. The receiving plane runs parallel to the plane receiving the weighing plates 28. Each of these weighing plates 28 is supported on the support frame 23 via a measurement mechanism 31, whereby a part of the measurement mechanism 31 is rigidly connected to the weighing plate 28 via an intermediate member 32 and is connected rigidly to the support frame 23 via a further intermediate member 33. Between these intermediate members 32, 33 a bending rod 34 is located, which is rigidly connected to the two intermediate members 32, 33. Measured value transducers 36 formed by measuring tapes 35 are arranged on the bending rod 34. Each of these measuring tapes 35 or measured value transducers 36 is connected to a measuring amplifier 37, in which an integrating mechanism 38 is also expediently arranged, but this need not necessarily be provided.

The measuring amplifier 37 connects to a bus system 39, possibly with bus interfaces 40 interposed, said bus system connecting these measuring amplifiers to the computer unit 24 or to the control device 27.

Figure 2:
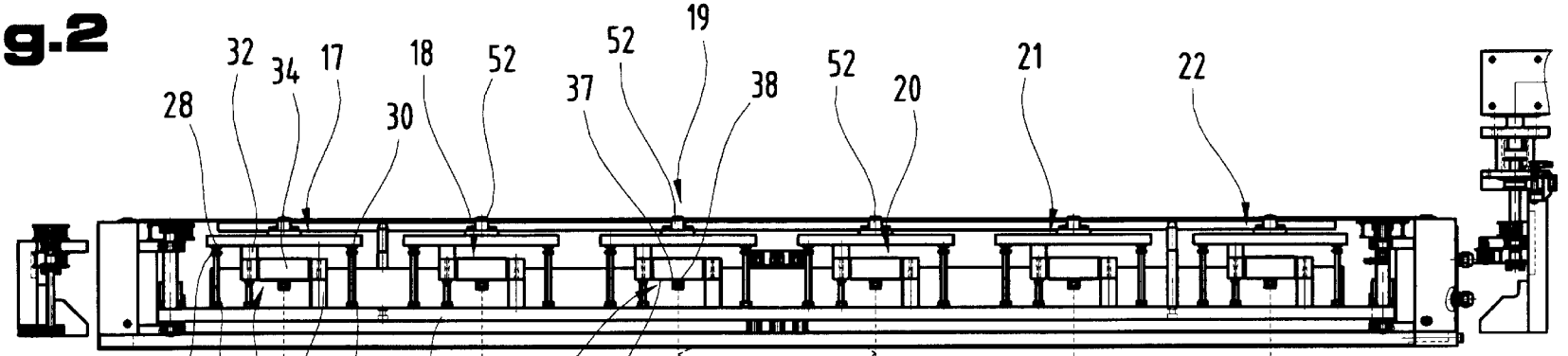
FIG. 2 is a side view of the monitoring means for several storage coils with storage coils removed, taken along lines II—II in FIG. 3.
Figure 3:
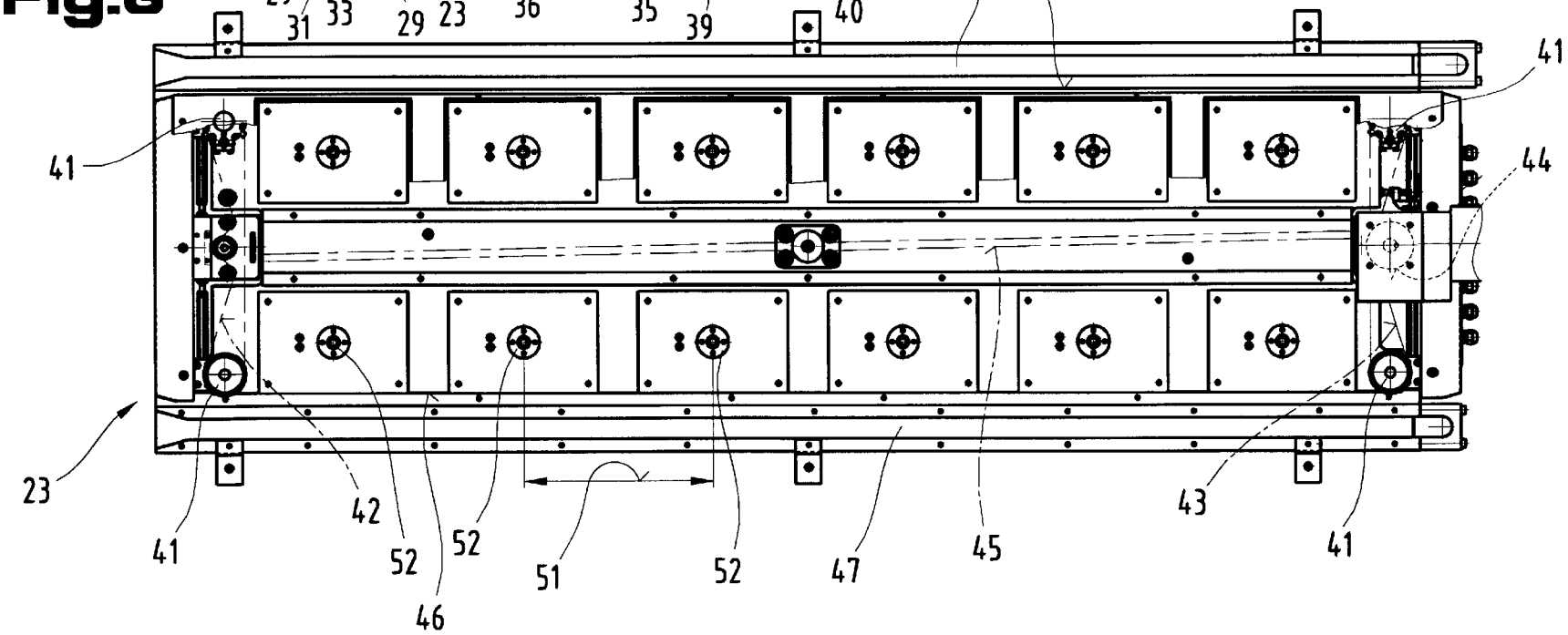
FIG. 3 is a simplified schematic plan view of the monitoring means according to FIG. 2 with the storage coils removed.
Figure 4:
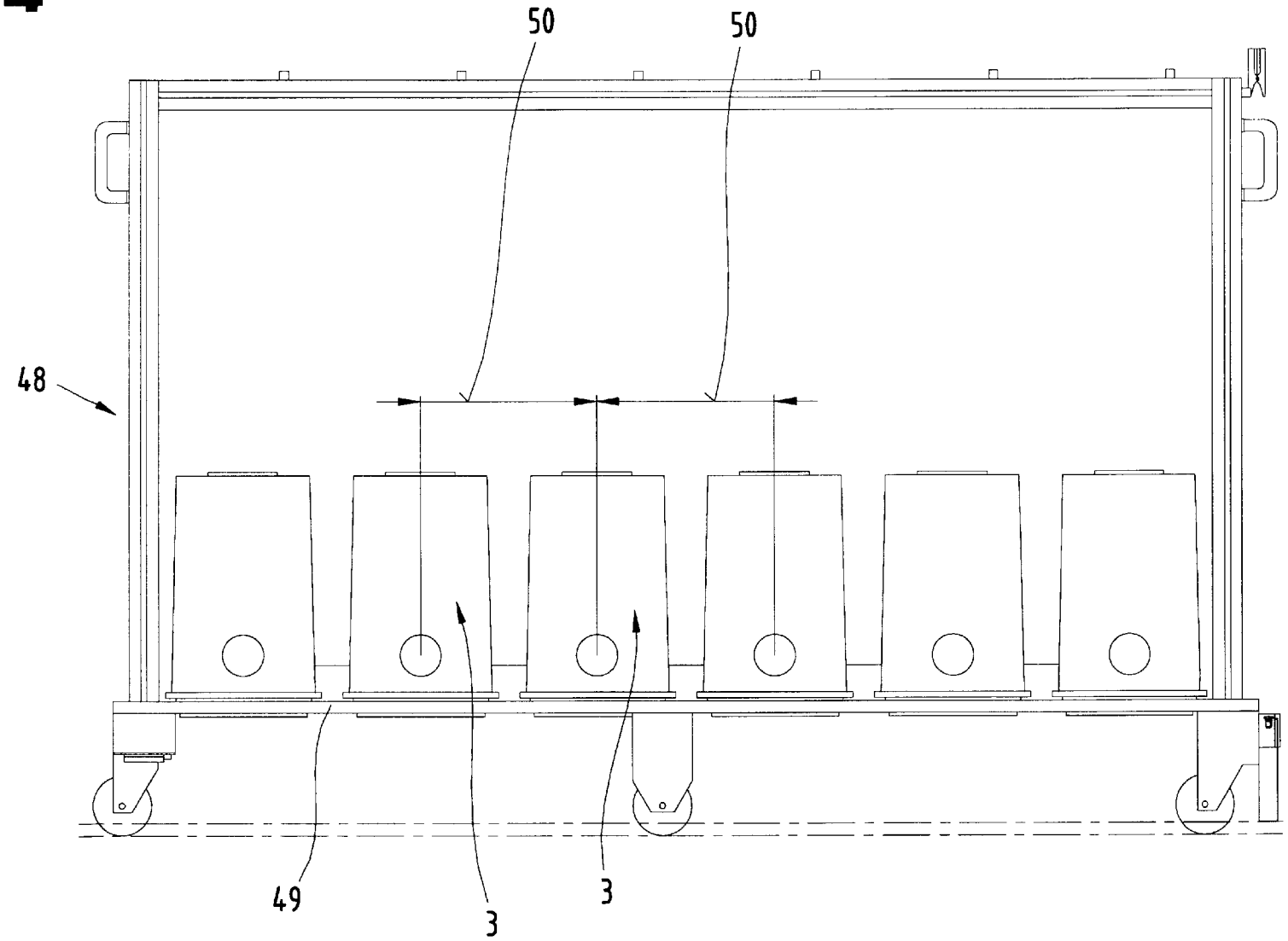
FIG. 4 shows a transport wagon for loading the weighing devices of the monitoring means with storage coils.

As may be seen in particular from FIGS. 2 and 3, the weighing devices 17 to 22 are arranged on the support frame 23 in two rows running parallel to one another. The support frame 23 is moreover disposed to be adjustable perpendicular to the weighing plates 28 via four lifting drives 41 arranged in the corner regions. The lifting drives 41 are expediently formed by lifting spindles operated via drive belts 42, 43, which are allocated to the two face end regions of the support frame 23. An adjusting drive 44 is provided in the region of one of the two drive belts 42 or 43 and is directly coupled with the drive belt 42, 43 to ensure synchronisation, for which the drive belt 42 in the present embodiment is coupled via a belt drive 45 to the adjusting drive 44, e.g. an electric motor or similar, or a deflection roller of the drive belt 43.

Guide rails 47 for a transport wagon 48 are arranged along longitudinal side edges 46 of the support frame 23. The storage coils 3 are arranged in two rows running parallel to one another on a loading pallet 49 of this transport wagon 48, six storage coils 3 being thereby provided one behind the other in the same graduation measurement 50 in each row. This graduation measurement 50 corresponds to the graduation measurement 51 between the weighing devices 17 to 22 arranged one behind the other in a row in longitudinal direction, i.e. to the centre distance or the distance between centring pins 52 arranged on these weighing plates 28. These centring pins 52 serve to centre the storage coils 3 on the weighing plates 28 so that the storage coils 3 are arranged centrally on the weighing plates 28 and cannot slip on the weighing plate 28 during removal of the thread-like material 2. This is important to prevent erroneous displays of the weight of the storage coils 3.

Such a transport wagon 48 makes it possible, for example, with an exchange of types on the processing machine 5, to exchange the storage coils 3 with a specific type of wire for storage coils 3 with another thread-like material 2. It is, of course, also possible in connection with this, when a storage coil 3 has run empty, to remove all the storage coils 3 with the transport wagon 48 from the monitoring means 1 or the weighing devices 17 to 22 and to fit it with the corresponding number of full storage coils 3 by a transport wagon 48. As a result of the arrangement of the lifting drives 41 or the vertical adjustability of the support frame 23 for the weighing devices 17 to 22, it is possible, when the storage coils 3 are positioned with the transport wagon 48 above the weighing devices 17 to 22, to move the weighing plates 28 upwards through the passages suited to their arrangement in the loading pallet 49 of the transport wagon 48 until the storage coils 3 lie on these weighing plates 28 and are centred with the centring pins 52 in order to raise them by moving the weighing plates 28 further upwards from the loading pallet 49.

When this raising operation of the storage coils 3 has finished, determination of the weight of the individual storage coils 3 can begin.

It is, of course, also possible to omit the lifting drives 41 and arrange the weighing devices 17 to 22 rigidly if the delivery and exchange of the storage coils 3 is performed manually or with lifting means, e.g. on the transport wagon 48. It is also possible in this case, however, as with the use of the transport wagon 48, to replace only individual empty storage coils 3 respectively with a full storage coil 3.

When one of the storage coils 3 has run empty or its thread-like material 2 has been consumed, the thread-like material 2 is severed between the storage coil 3 and the wire take-up 15, the empty storage coil 3 is removed from the weighing plate 28 and replaced by a full storage coil 3. The thread-like material 2 from the full storage coil 3 is joined to the remaining end of the thread-like material 2 of the preceding storage coil 3, e.g. by positive means by linking or twisting, or possibly also by non-positive means by soldering or gluing.

Once this joining process has been concluded, the winding process is continued with the processing machine 5—as will be described below in detail.

To ensure that the weighing devices 17 to 22 are not damaged in the case of overload by mistake, the excess load stops 30 are arranged on the vertical guide means 29, said stops ensuring that, in the case of too high a weight, the weighing plate 28 can be supported on the vertical guide means 29, e.g. threaded rods, after corresponding deformation of the bending rod 34, and therefore the bending rod 34 with the measured value transducer 36 arranged thereon cannot be damaged.

The method of functioning of the monitoring means 1 will now be described in detail on the basis of the block diagram in FIG. 6 and a flow chart in FIG. 5.

The computer unit 24, which may be formed, for example, by a personal computer with associated screen and an input keyboard, has corresponding memory locations 25, 26 in the program or in the computer unit 24 for storage of a desired residual quantity of the thread-like material 2.

Moreover, it is also possible to provide further memory locations 53 for the dimension of the material 2, e.g. the diameter and, if desired, for the length and/or weight of the thread-like material 2 minus the tare weight or the weight of the storage coil 3 or storage spool.

In addition, the removal quantity of the thread-like material 2 required in a removal cycle can be fixed at an additional memory location 54 in dependence on the required length and/or weight. It is additionally also possible to input a desired residual quantity for the thread-like material 2 on the basis of the required length or of the required weight and store it in the computer unit 24. Moreover, a selection residual quantity, which is higher than the desired residual quantity, can be pre-defined and input.

It is, of course, also possible to store a series of values or individual data sets for different thread-like materials 2 in order to call these on input of the products to be produced and to fully automatically make these the basis of further calculation.

The input of individual measured values can be achieved in this case via the keyboard of the computer unit or corresponding data can, of course, also be read in by superset storage units, e.g. operational data storage units, data bank programs. These data may also possibly be read into the computer unit 24 by appropriate hardware components storing these data or be transmitted into the computer unit.

The program sequence now begins with the calibration of the monitoring means 1, in particular the weighing devices 17 to 20. For this, the appropriate program in the computer unit 24 is activated and the weighing device 17 to 22 to be calibrated is selected. The individual working steps to be taken are then displayed on the screen. Hence, the weighing device 17 to 22 provided for calibration should firstly be relieved of load, i.e. loaded with a zero mass. After this working step has been confirmed, the current measured value is stored in the computer unit 24 and the operator requested to load the weighing device 17 to 22 with a reference mass. This reference mass, the exact weight of which must be stored previously at a memory location 54 of the computer unit 24, advantageously corresponds approximately to the tare weight or the weight of the storage coil 3 and its packing. This has the advantage that the weighing devices 17 to 22 are calibrated to this weight and the measurement deviation of the weighing devices 17 to 22 is at its lowest in the region of this reference value. After confirmation in the program, a measurement curve is calculated, with reference to the reference mass, and this curve is input or stored in the computer unit 24, if desired.

Figure 5A:
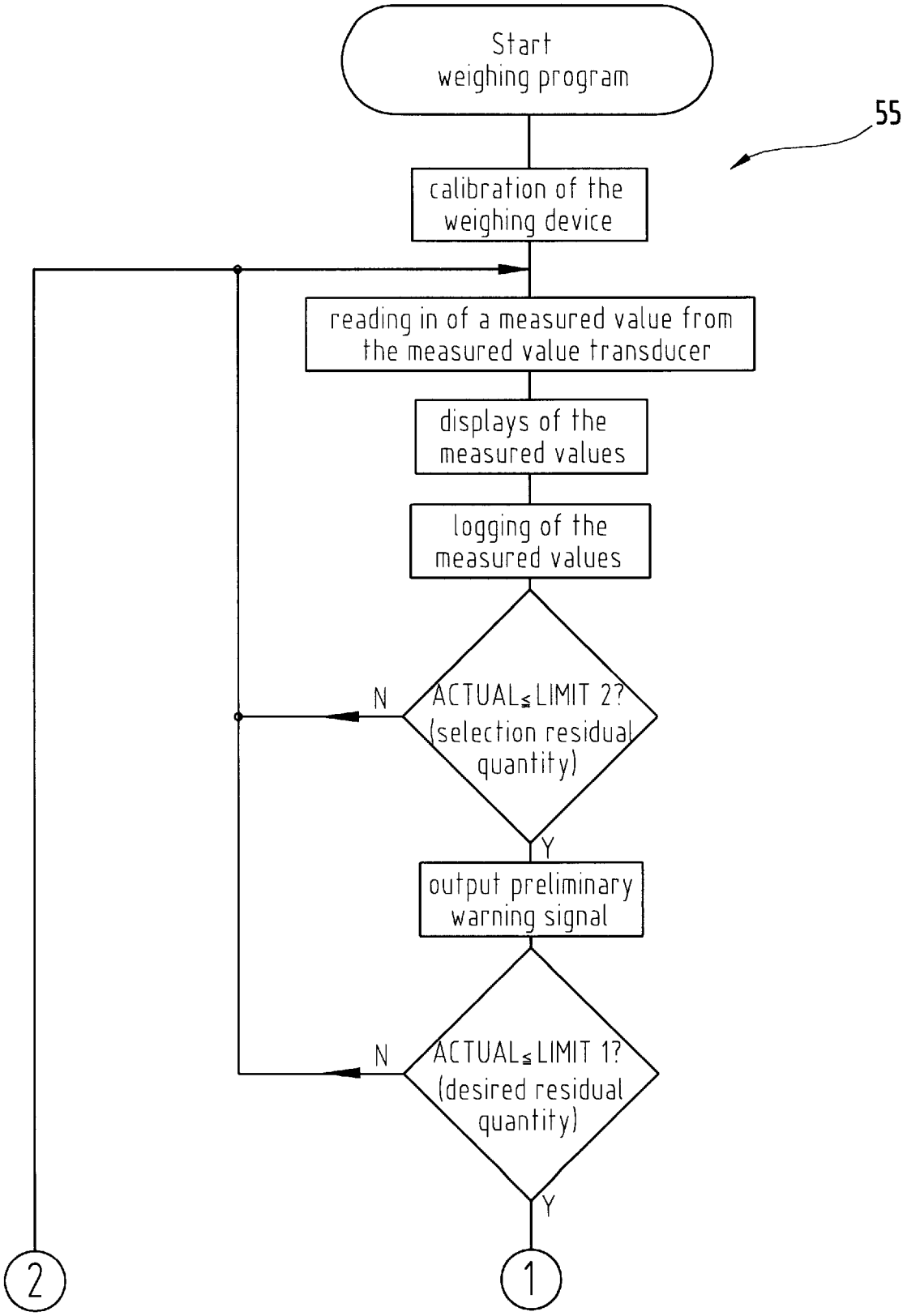
FIG. 5*a* is the initial portion of a simplified schematic flow chart for the control device of the monitoring means.
Figure 5B:
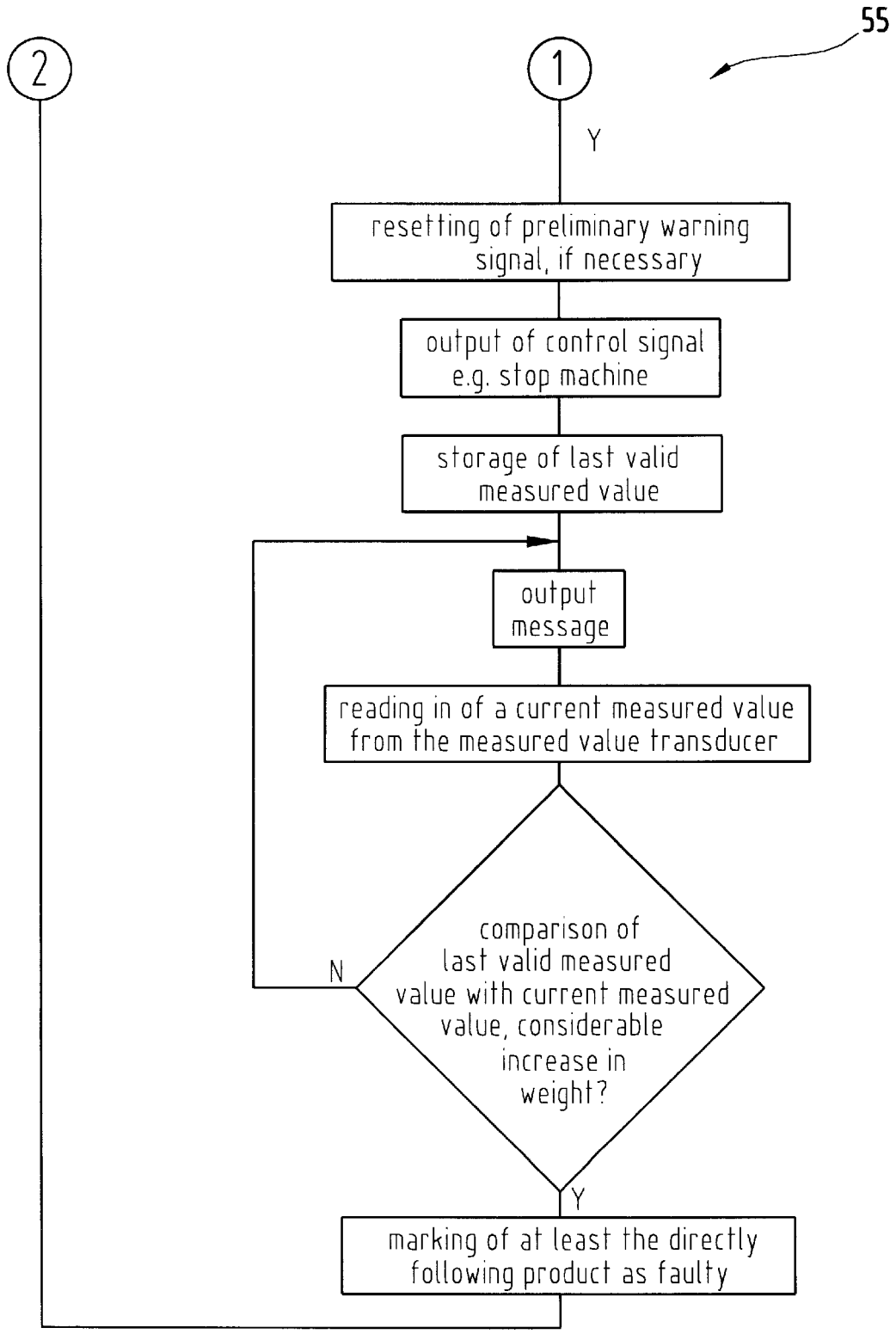
FIG. 5*b* shows the continuation of this chart.
Figure 6:
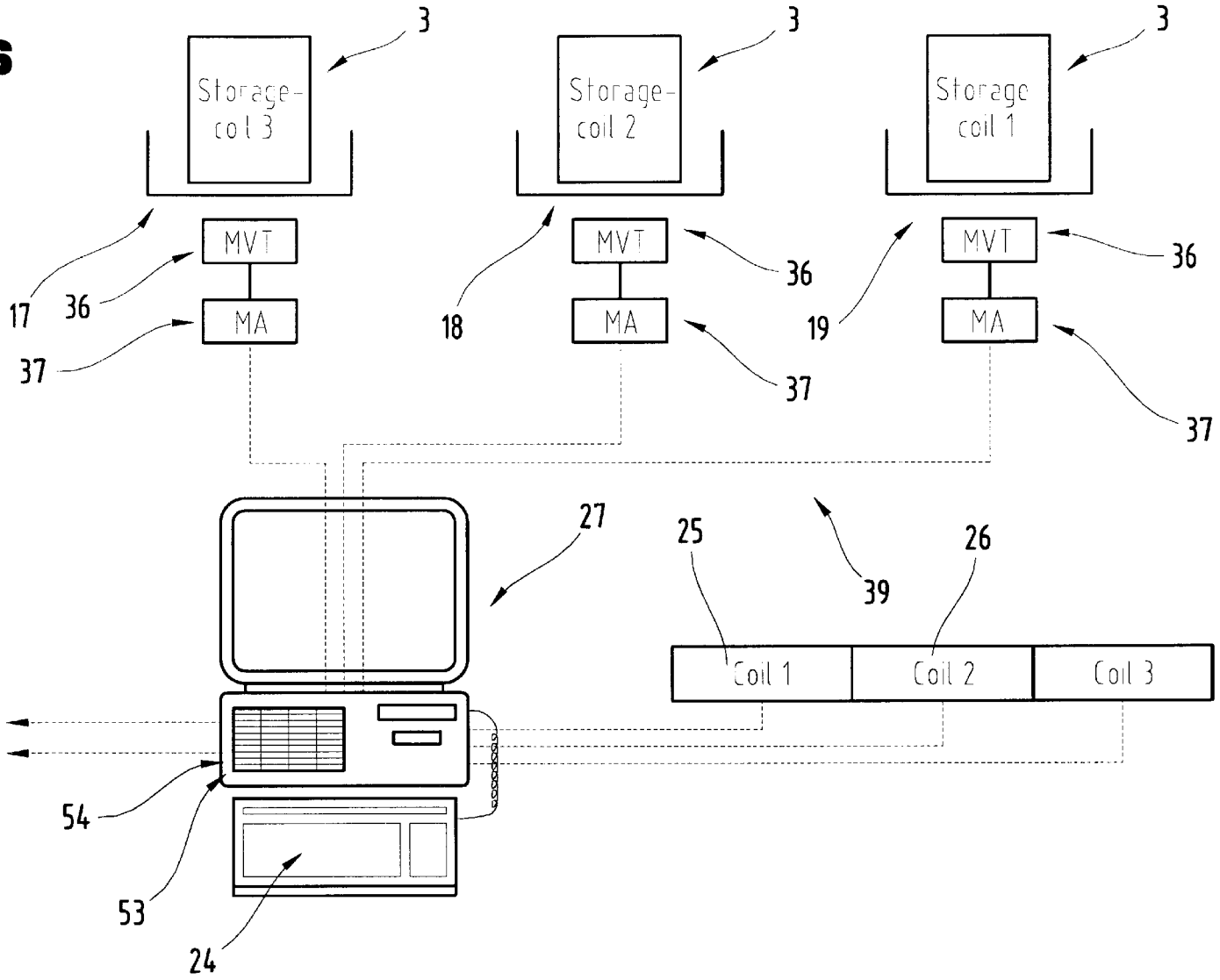
FIG. 6 is a block diagram of the control devices allocated to the monitoring means according to the invention.

In addition, the function of the monitoring means 1 after calibration during the unwinding of the thread-like material 2 is explained in more detail in FIGS. 5 and 6 on the basis of a flow chart 55 and a block diagram of the control device 27 and the weighing devices 17 to 22, of which only weighing devices 17 to 19 are shown.

The weighing program is started up in the usual manner after calibration has been achieved, or by putting into operation the control device 27, e.g. the computer unit 24. This process also described as booting is to be carried out each time the plant has been put back into operation after a longer interruption in operation.

This starting up or booting can, of course, also be performed by a superset control device 10—FIG. 1—or a central control switch for an entire assembly or winding plant.

After start-up of the weighing program, a measured value is output from the measured value transducers 36, in particular from the bending rods 34, by the weighing devices 17 to 19 shown schematically in FIG. 6, and possibly read into the computer unit 24 upon amplification or upgrading by a measuring amplifier 37.

When the filled storage coils 3 are placed on the weighing devices 17 to 22 after their calibration, their weight is determined with the measured value transducers 36 and respectively stored in the computer unit 24. Simultaneously or directly after the measured values from the measured value transducers 36 have been stored or read in, these are compared respectively with the measured values of the desired residual quantity or selection residual quantity stored in the individual memory locations 25, 26.

However, when the program is started up after the machine has already removed thread-like material 2 from the storage coils 3 for some time, the original weight permanently stored in the memory locations 25 and 26 forms the basis for further calculations like the desired residual quantity or selection residual quantity already defined at this point in time, which can be stored in the respective control device 27 in dependence on the respective products to be produced, or can be read in again from a central program computer at the beginning of the production process.

In addition, the corresponding measured values for all the weighing devices 17 to 22 or for respectively definable weighing devices 17 to 22 can be displayed and, if desired, logged and/or stored.

The display can vary and comprise the weight of the thread-like material 2 still located on the storage coil 3 and/or the time still remaining until the desired residual quantity is reached with reference to an undisturbed production period of the processing machine.

During the working process it is now constantly compared in a comparison operation whether the currently read-in residual quantity is greater on the storage coil 3 than the selection residual quantities stored at the memory location 25 or 26.

If the residual quantity of thread-like material 2 on the individual storage coils 3, which are monitored with the weighing devices 17 to 22, is greater than selection or desired residual quantities defined at the corresponding memory locations 25, 26, this process of monitoring comprising reading in the current measured values and comparison with the reference values or selection or desired residual quantities is continued on a continuous basis.

It is, of course, possible for this that each individual storage coil 3 can be allocated its own memory location for the residual quantities. However, it is also possible, on the one hand, to store the residual quantities required for all weighing devices 17 to 22, so that the same thread-like materials 2 are processed, at a single memory location 25, 26, or to fix several storage devices 25, 26 with individual values for selection or desired residual quantities respectively for groups of storage coils 3, on which the same thread-like material 2 is processed.

If the values fall below the threshold value for the selection residual quantity after processing a corresponding quantity of material 2, it is possible, for example, that the display device for the corresponding measured values, e.g. the screen of the computer unit 24, confuses the colour and/or an optical or acoustic alarm signal is emitted. It is possible thereby that an end of wire preliminary warning signal, with reference to the corresponding weighing device 17 to 22 and/or the appropriate winding head 14, is transmitted to the control device 16 of the processing machine 5—FIG. 1.

The monitoring and checking of the weight of the storage coil 3 is continued on a continuous basis, whereby the respective weight of the storage coil 3 is henceforth also compared with the desired residual quantity, which can be stored at the memory locations 25, 26 in the control device 27 in order to henceforth establish when the weight of the storage coil 3 reaches this desired residual quantity. The program sequence may be provided thereby so that an end of wire preliminary warning signal is constantly emitted as a reminder respectively when the program loop is passed through when it has been established that the value has fallen below the selection residual quantity.

If the respective reference measured value, e.g. the weight or a length of the thread-like material 2, then falls below the threshold for the desired residual quantity, a control signal is transmitted which interrupts the operation of the processing machine 5. At the same time or instead of this, a message can be sent out to the operator of the monitoring means 1 to change the storage coil 3.

It is, of course, also possible at this point to reset the end of wire preliminary warning signal. However, this can also occur at a later time point still to be defined, e.g. after exchange of the empty storage coil 3 for a full storage coil 3.

As a result of this standstill of the processing machine 5 the winding process is not continued in any way in order to prevent the possibility of the thread-like material for production of the next product no longer being completely adequate, thus at the same time excluding the possibility of the thread-like material being pulled completely out of the winding machine 5. For the further working steps and control sequences, different procedures are now possible which can run in succession or parallel to one another, whereby it is also possible that only individual program steps or control functions, as may be seen from the flow chart 55, are respectively performed. Hence, it is possible, for example, that the processing machine 5, or if this is integrated into a fully automatic assembly plant 6, emits an optical or acoustic alarm signal in order to indicate to the machine operator the operations to be performed. This is now possible such that either several processing machines 5 are connected one behind the other, so that when the thread-like material 2 on a processing machine 5 runs out, the entire assembly plant or winding plant does not come to a standstill, but operation can continue at reduced output until the empty storage coil or coils 3 is/are replaced by a full storage coil or full storage coils.

As already described above, the monitoring process is now initiated once again after the full storage coil 3 has been placed on the weighing devices 17 to 22 or one of these weighing devices 17 to 22, depending on whether all the storage coils 3 or only those where the desired residual quantity has been reached are exchanged in such a starting case, regardless of the respective residual quantity of thread-like material 2 on the storage coils 3.

The end of the wire of the thread-like material 2 of the preceding empty storage coil 3 is joined to the leading edge of the wire of the newly attached storage coil 3, and it is expediently provided that this process is stopped at the control device 27 by the operator.

It is, of course, also possible that the entire signal transmission to the operator or the transmission of the product information and similar is achieved in a cordless manner via remote transmission or communication systems onto a pager, a telephone and other cordless control device of the machine operator, and stoppage of the work processes performed may, of course, also be carried out on this control device, pager or telephone.

This control signal can, of course, also effect the output of information that there is something wrong with the next structural part to be produced—NiO part—and/or effect marking of the part, since the connection point between the thread-like material parts or material ends is present in this part or in this coil 7. A starting signal or release signal for the processing machines 5 may, of course, also be derived when a substantial increase in weight is automatically detected on the weighing devices 17 to 22 by monitoring of the functions and control signals. This circumstance is detectable by comparison of earlier or previously valid measured values with the current actual measured value or on the basis that the weight of the storage coils 3 has increased considerably in relation to the desired residual quantity.

For this case, the control device 27 or the program running on this may then also be constructed so that these previously described functions and control signals are generated automatically by the control device 27.

Continuation of the operation of the processing machine 5 is only possible when the storage coil 3 has been exchanged and the read-in measured values exceed the pre-defined thresholds for the selection residual quantity.

It is possible, of course, to store all the changing data, the different operating conditions and all processes occurring in one of such exchanges of the storage coil 3 in the control device 27 or the superset control device 10 in order to constantly optimise the course of the exchange of the storage coil 3 with increasing operating time of the plant or monitoring means 1.

The use of measuring amplifiers 37 in conjunction with each weighing device 17 to 22 has the advantage that the individual measured values can be evaluated simultaneously and may also be transmitted via serial interfaces over a known, e.g. standardised bus system 39, to the control device 27.

Preferably, it is advantageous if the measuring amplifiers 37 are allocated directly to or connected downline of the measured value transducers 36 and have their own integrating mechanism 38 so that, for example, they form a mean value of a multiple, e.g. of a hundred individual measured values, and only this mean value is transmitted into the control device 27. The accuracy of the measured value detection can thus be increased.

For accurate weight detection, it is, of course, also advantageous when the respective tare weight of the empty storage coil 3 is collected over a longer period or is stored in the control device 27 separately for each type of storage coil 3. The tare weight amounts to 2479 grams, for example, for a storage coil with a nominal load or maximum load of up to 36 kilograms, 25 to 30 kilograms of thread-like material 2 being arranged on such a coil.

To be able to perform an even more accurate detection of the residual quantity of thread-like material present, it is also possible to arrange a bar code or other information or marking, e.g. on a magnetic strip or in a chip integrated into the storage coil 3, on the storage containers 3 or on any other point thereof, and the net weight of the spooled thread-like material 2 is given there.

This value can be detected when a new storage coil 3 is attached, e.g. via corresponding reading or scanning means, and can also be fed directly into the control device 27, as a result of which measured value deviations resulting from the tare weight, i.e. from the weight of the storage coil 3, can be excluded during detection of the wire end.

The advantage of this serial feed via a bus system 39 is above all that a very short measurement cycle of only 2 seconds, for example, can be achieved in order to scan the status of a total of 24 weighing devices 17 to 22.

Figure 7:
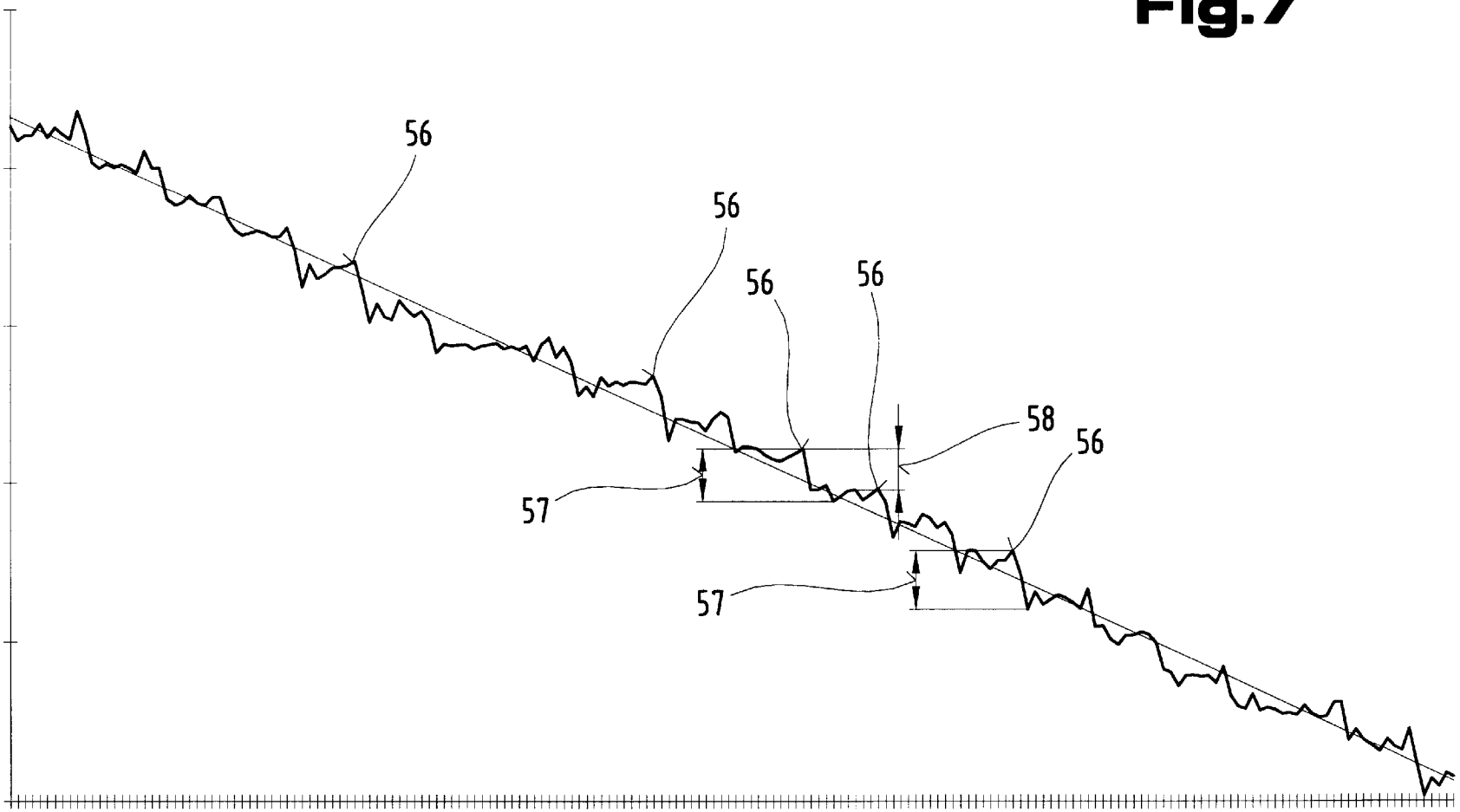
FIG. 7 is a graph of the weight curve of a storage coil detected by a monitoring means according to the invention.

FIG. 7 shows a graph of the constantly changing weight curve detected with the measured value transducers 36, viewed in conjunction with FIGS. 1 to 4.

It is very clearly evident from this graph that by removing the thread-like material 2 from the storage coil 3, this is relieved of its load to a different degree as a result of the removal force acting on the storage coil 3.

Only when the unwinding process has finished again, does the weighing device 17 to 22 show the actual weight of the residual quantity of the thread-like material 2 an the storage coil 3. This residual quantity of the thread-like material 2 present, or the respective actual measured value in dependence on the elapsed time, is clearly evident at the points referenced 56 in the graph according to FIG. 7.

Directly after the stoppage, when the thread-like material 2 is removed at the beginning of the new winding movement, a correspondingly high reduction in weight by a value 57 may be seen, of course, in dependence on the removal speed and/or the layering density of the thread-like material 2 on the storage coil 3.

This value 57 is also a magnitude concerning the orderly processing or the orderly spooling of the thread-like material 2 for the inductive coil 7 to be produced. If irregularities have resulted here, e.g. dense spooling in individual regions of the coil body of the coil 7 to be produced, then the load relief of the storage coil 3 during tightening of the thread-like material 2 becomes greater in an aliquot manner as a result of the sudden increase in diameter of the winding body or coil 7, and therefore the quality of the thread-like material 2 or the winding on the storage coil 3 and/or the inductive coil 7 can also be monitored by this value 57.

If the value 57 increases above a limit possibly stored in a further memory location, then this can be a magnitude for the effect that a disturbance, as a result of poor spooling of the thread-like material 2, e.g. as a result of a wire tear, has been triggered on the storage coil 3 because of the high hold-back force of the thread-like material 2, and it is therefore also possible to interrupt the winding process in good time, for example, before such a wire tear occurs.

A difference 58 between two points 56 in the measurement graph in FIG. 7 otherwise gives information concerning the weight of the unspooled quantities of the thread-like material 2. Moreover, the actual weight of the residual quantity of thread-like material 2 still contained on the storage coil 3 is always at its most exact at locations 56 of the points in the graph, since as a result of this the weighing devices 17 to 22 have fully come to rest at this point between the individual winding processes, and an exact uninfluenced measured value detection is possible at these points in time.

Moreover, it is also possible that, on the basis of the heavy increase in weight established with the weighing devices 17 to 22 during exchange of an empty storage coil 3 for a full storage coil 3, the monitoring means 1 automatically detects this change and automatically derives different functions from the respective status. Hence, amongst other things, the next structural part or the next structural parts can be automatically coded or marked as faulty parts, since the connection point between the remaining thread-like material 2 of the empty storage coil 3 and the new thread-like material 2 of the full storage coil 3 may be contained in one or more of the following structural parts. Moreover, the wire knot can cause damage to the thread-like material at the leading edge of the wire, and winding of the thread-like material 2 may possibly occur at lower speed or lower load for the thread-like material 2 in order to prevent further disturbances in this transition phase.

Moreover, it is naturally directly possible to use the weight curve for quality assurance or wire protection or for monitoring the order conditions with suppliers of the thread-like material 2 or wire during removal of the thread-like material 2, as will still be described below in detail.

It must also be noted, purely for the sake of order, that in addition to the described procedure in the detection of the weight of the thread-like material 2, it is also possible for establishing the residual weight to subject the quantity of the thread-like material 2 to a resistance detection in particular when an electrical conductor is concerned.

For this it is possible to apply an electric voltage at the winding point, to tap in the region of the storage coil, in particular in the region of the further end of the thread-like material 2 and to determine the remaining length of the thread-like material 2 on the basis of the ohmic resistance. However, it should be taken into consideration here that this process may only be used when the electrical conductor is insulated with an enamel layer, for example. It would, of course, also be possible to induce a voltage in a contactless manner in the coil 7 during unwinding by this moving in a magnetic field or to scan by capacitance the residual quantity of the thread-like material 2 on the storage coil 3. This monitoring of the residual quantity of the thread-like material 2 can, of course, also be achieved solely by the previously described possible solutions.

For the sake of order, it must be noted in conclusion that for better understanding of the structure of the monitoring means 1 or of the processing machine 5, these or its components have been shown in some cases not to scale and/or enlarged and/or reduced in size.

The object forming the basis of the independent inventive solutions can be taken from the description.

Above all, the individual embodiments shown in FIGS. 1, 2, 3, 4, 5, 6, 7 can form the subject of independent solutions according to the invention. The relevant objects and solutions according to the invention may be seen from the detailed descriptions of these figures.

What is claimed is:

1. Monitoring means for an end of a thread-shaped material wound on a storage coil, the monitoring means forming part of a processing machine and comprising (a) a computer unit including (1) a first memory location for storing a predetermined desired value for a desired residual quantity of the thread-shaped material and (2) a further memory location for storing the tare weight of the storage coil; and (b) a weighing device including a measured value transducer, the weighing device at least intermittently receiving the storage coil for measuring the actual value of weight, and the meassured value transducer being coupled to the computer unit, the computer unit determining when the sum of the desired value of the desired residual quantity and the tare weight of the storage coil correspond to the actual value.

2. The monitoring means of claim 1, wherein the desired residual quantity of the thread-shaped material is greater than a quantity of the thread-shaped material to be removed from the storage coil during a removal cycle.

3. The monitoring means of claim 2, wherein the desired residual quantity of the thread-shaped material is at least 1.5 times the quantity of the thread-shaped material to be removed from the storage coil during a removal cycle.

4. The monitoring means of claim 1, wherein the computer unit is arranged to generate a control output signal indicating when the value of the desired residual quantity corresponds to the measured actual value.

5. The monitoring means of claim 1, wherein the computer unit is arranged to generate a control output signal indicating when the value of the desired residual quantity is less than the measured actual value.

6. The monitoring means of claim 1, wherein the computer unit is arranged to generate a preliminary warning signal indicating when a value of a selected residual quantity corresponds to the actual value.

7. The monitoring means of claim 6, wherein the storage coil upon which the selected residual quantity is wound remains on the weighing device when the preliminary warning signal is generated until the desired residual quanity has been reached.

8. The monitoring means of claim 1, wherein the computer unit is arranged to generate a preliminary warning signal indicating when a value of a selected residual quantity is less than to the actual value.

9. The monitoring means of claim 8, wherein the selected residual quanity is greater than the desired residual quantity.

10. The monitoring means of claim 1, wherein the weighing device is arranged for at least intermittently receiving several different storage coils.

11. The monitoring means of claim 1, comprising a plurality of said weighing devices for receiving a plurality of different ones of said storage coils.

12. The monitoring means of claim 11, wherein the computer unit includes a plurality of the first and further memory locations, each memory location being allocated to a respective one of the weighing devices.

13. The monitoring means of claim 1, wherein the computer unit records the measured actual value at least during a part of the removal of the thread-shaped material from the storage coil.

14. The monitoring means of claim 1, further comprising a measuring amplifier including an integrating mechanism connected to an output of the measured value transducer.

15. The monitoring means of claim 1, further comprising a bus system coupling the measured value transducer to the computer unit.

16. The monitoring means of claim 1, wherein a calibration weight of the weighing device corresponds approximately to the tare weight.

17. The monitoring means of claim 1, wherein the processing machine comprises a coiling device for the thread-shaped material, and the monitoring means is upstream of the coiling device.

18. The monitoring means of claim 17, wherein the computer unit is arranged to generate an output control signal indicating when the value of the desired residual quantity corresponds to the measured actual value, and the control signal prevents activation of the coiling device.

19. A process for monitoring an end of a thread-shaped material unwinding from a storage coil during processing of the unwound thread-shaped material, which comprises the steps of weighing the storage coil, continuously measuring values of the weight, feeding the measured values to a computer unit, and comparing the measured values with a predetermined value of a residual quantity of the thread-shaped material on the storage coil.

20. The monitoring process of claim 19, wherein the measured values are compared with a desired residual quantity of the thread-shaped material.

21. The monitoring process of claim 20, wherein a control signal for stopping the processing of the thread-shaped material is generated when the predetermined value of the residual quantity has been reached.

22. The monitoring process of claim 21, wherein a perceptible message is emitted with the control signal for exchanging the storage coil from which the thread-shaped material has been unwound.

23. The monitoring process of claim 20, wherein a control signal for stopping the processing of the thread-shaped material is generated when the residual quantity is less than the predetermined value.

24. The monitoring process of claim 23, wherein a perceptible message is emitted with the control signal for exchanging the storage coil from which the thread-shaped material has been unwound.

25. The monitoring process of claim 19, wherein the measured values are compared with a selected greater residual quantity of the thread-shaped material.

26. The monitoring process of claim 25, wherein a preliminary warning signal is generated when the selected greater residual quantity has been reached.

27. The monitoring process of claim 25, wherein a preliminary warning signal is generated when the selected greater residual quantity is less than the predetermined value.

28. The monitoring process of claim 19, wherein large surges in the measured values are recognized as an exchange of the storage coil, and the next processed product is removed as faulty.

29. The monitoring process of claim 19, wherein a weighing device for weighing the storage coil is calibrated before the weighing.

30. The monitoring process of claim 29, wherein the weighing device is calibrated by placing a reference mass thereon.

31. The monitoring process of claim 29, wherein the weighing device is calibrated by completely relieving the load thereon.

32. The monitoring process of claim 19, wherein a value transducer for continuously measuring values of the weight is calibrated before the measuring of the values.

33. The monitoring process of claim 19, wherein an evaluation device of the computer unit is calibrated before the measured values are compared with a predetermined value of the residual quantity of the thread-shaped material on the storage coil.

34. The monitoring process of claim 19, wherein the tare weight of the storage coil is stored in the computer unit.

35. The monitoring process of claim 19, wherein the continuously measured values serve as a measure of the quality of the processed product.

36. The monitoring process of claim 19, wherein the continuously measured values serve as a measure of the quality of the thread-shaped material wound on the storage coil.

* * * * *